US008277339B2

(12) United States Patent
de la Gandara et al.

(10) Patent No.: US 8,277,339 B2
(45) Date of Patent: Oct. 2, 2012

(54) BALL ROLLING DEVICE

(76) Inventors: Ramón Bescansa de la Gandara, Santiago de Compostela (ES); Gonzalo Redondo, La Coruña (ES)

( * ) Notice: Subject to any disclaimer, the term of this patent is extended or adjusted under 35 U.S.C. 154(b) by 92 days.

(21) Appl. No.: 12/821,679

(22) Filed: Jun. 23, 2010

(65) Prior Publication Data

US 2010/0331119 A1 Dec. 30, 2010

Related U.S. Application Data

(60) Provisional application No. 61/221,835, filed on Jun. 30, 2009.

(51) Int. Cl.
*A63B 69/36* (2006.01)

(52) U.S. Cl. ..... 473/405

(58) Field of Classification Search ..... 473/404, 473/405, 279, 157, 160, 54–56; 273/120 R, 273/129 Q
See application file for complete search history.

(56) References Cited

U.S. PATENT DOCUMENTS

| | | | | | |
|---|---|---|---|---|---|
| 1,689,475 | A | * | 10/1928 | Brumder | 473/184 |
| 2,796,261 | A | | 6/1957 | Turner | |
| 3,159,401 | A | * | 12/1964 | Ikenberry | 473/56 |
| 3,481,601 | A | * | 12/1969 | Santora | 473/56 |
| 3,539,183 | A | * | 11/1970 | Lieb | 473/56 |
| 3,578,322 | A | * | 5/1971 | Kerr | 473/56 |
| 4,097,045 | A | * | 6/1978 | Bechtel | 473/56 |
| 4,286,784 | A | * | 9/1981 | Harvey et al. | 473/55 |
| 5,165,690 | A | * | 11/1992 | Kelley, Jr. | 473/184 |
| 5,183,261 | A | * | 2/1993 | Nobi | 473/109 |
| 5,199,704 | A | * | 4/1993 | Badami | 473/2 |
| 5,314,384 | A | * | 5/1994 | Ross-Sullivan | 473/55 |
| 5,358,446 | A | * | 10/1994 | Bergman | 473/56 |
| 5,358,447 | A | * | 10/1994 | Erickson | 473/56 |
| 5,556,106 | A | | 9/1996 | Jurcisin | |
| 6,042,482 | A | * | 3/2000 | Wilds | 473/107 |
| 6,227,981 | B1 | * | 5/2001 | Troncoso et al. | 473/56 |
| 6,475,096 | B2 | * | 11/2002 | Nickolai | 473/56 |
| 6,547,680 | B1 | * | 4/2003 | Marchese, Jr. | 473/404 |
| 6,860,139 | B2 | * | 3/2005 | Pelz | 73/9 |

(Continued)

FOREIGN PATENT DOCUMENTS

FR 2481605 A1 11/1981

(Continued)

OTHER PUBLICATIONS

European Search Report Application No. EP 10 00 6669.
Response to EP Communication.

*Primary Examiner* — Raleigh W. Chiu
(74) *Attorney, Agent, or Firm* — Collen IP; Donald J. Ranft

(57) ABSTRACT

Described herein is a rolling ball device comprising a pair of ball support structures secured together and spaced apart so as to support a golf ball there between, each of the ball support structures having a first portion having a first end and a second end and having a first surface with a clothoid shape and having a second portion having a first end coupled to a second end of the first portion and a second end, the second portion having a first surface having an arc shape and having a third portion having a first end coupled to the second end of said second portion and having a second end, the third portion having a first surface having an inverted clothoid shape.

8 Claims, 12 Drawing Sheets

U.S. PATENT DOCUMENTS

| | | | | |
|---|---|---|---|---|
| 7,225,663 | B2 * | 6/2007 | Pelz | 73/9 |
| 7,597,558 | B2 * | 10/2009 | Mazloompour | 434/247 |
| 2002/0072425 | A1 * | 6/2002 | Nickolai | 473/56 |
| 2003/0226393 | A1 * | 12/2003 | Pelz | 73/9 |
| 2004/0097303 | A1 * | 5/2004 | Hughes | 473/404 |
| 2005/0145011 | A1 * | 7/2005 | Pelz | 73/9 |
| 2010/0331119 | A1 * | 12/2010 | de La Gandara et al. | 473/404 |

FOREIGN PATENT DOCUMENTS

| | | | |
|---|---|---|---|
| FR | 2873932 | A1 | 2/2006 |
| GB | 2267039 | A * | 11/1993 |
| JP | 8196675 | A | 8/1996 |

* cited by examiner

BALL ROLLING DEVICE

CROSS-REFERENCE TO RELATED APPLICATIONS

This application claims priority from U.S. Provisional Patent Application No. 61/221,835, filed Jun. 30, 2009, incorporated herein by reference in its entirety for all purposes.

FIELD OF THE INVENTION

The structures and techniques described herein relate to training aids and more particularly to a device for rolling a ball.

BACKGROUND OF THE INVENTION

As is known in the art, in the game of golf one type of golf shot is called a putt. A putt is a shot designed to roll a golf ball along the ground. It is normally made on a putting green using a golf club referred to as a putter, although other clubs may be used to achieve the same effect in different situations.

As is also known, putting (i.e. the act of a golfer executing a putt shot) is considered by many golfers to be one of the most important shots in golf. In particular, for those players wishing to achieve a low score or a low handicap, it is important to be able to accurately putt the golf ball since approximately 45% or more of shots made during a golf game are played with the putter.

As is also known, factors like the condition of the greens or the ball type can make a difference in the characteristics of the speed and direction of a golf ball when it is putted. A golf ball does not always begin to roll at the same time and since striking a golf ball with a golf club results in imperfections in the surface of the golf ball not all golf balls have a surface which is substantially free of imperfections. When a golfer reaches the level of professional golf, putting ability often becomes a significant factor in determining the winner of a golf match.

For a long time, putting was the only part of a golf game that golf teachers (also sometimes referred to as "golf professionals" or more simply, "golf pros") would not teach because they believed that putting was very personal. Thus, for a period of time, every player taught themselves how to putt.

Some golfers believe that putting is more about feeling; a professional golfer knows that the more chances they give themselves to putt the golf ball into the hole, the more putts they are going to convert. Therefore, confidence in putting is very important, and the more confidence a player has, the more putts they are going to make.

A stimp-meter is a ramp apparatus used to measure green speed. Thus, stimp meters fail to address many factors involved in putting a golf ball on a golf green. One device directed toward putting is called a "True-Roller." This device is a ramp that is similar to the stimp-meter. The True Roller device, however, differs from a stimp meter in that it has a little better exit with a little curve at the end.

SUMMARY OF THE INVENTION

One objective of the concept described herein is to provide a ball rolling device that any golfer can use to simulate the execution of a perfect putt without using the putter and which provides a roll which is difficult, if not impossible, to consistently achieve even for a professional golfer. The ball rolling device is a structure for rolling a golf ball at a repetitive speed and direction, to simulate the execution of a perfect or near perfect put.

With such a ball rolling device, a golfer (e.g. a professional golfer or an amateur golfer as well as caddies or other persons with an interest in golfing or putting (all such persons collectively referred to herein as a golfer) can practice knowing the exact break on a putt and thus allows a golfer to determine one or more different strategies to execute the same putt. The rolling ball device gives a golfer the right speed and alignment information need to putt a golf ball to a desired location (e.g. into a hole on the golf green). Since the golfer can see what precisely how a putted ball behaves (the golfer can see the speed and line to the hole, for example), the golfer can hit puts with precision and consistency. Knowing the precise line and speed at which to putt a golf ball can lead a golfer (including, but not limited to a professional golfer) to gain a lot of confidence. Knowing the precise line and speed at which to putt a golf ball can also make the golfer's practice time a lot more productive since, prior to the ball rolling device described herein, determining the precise line and speed at which to putt a golf ball could be a relatively difficult and time consuming activity.

The concept described herein is to provide a structure having a shape which transfers energy to a ball (i.e. transfers potential energy into kinetic energy), such as a golf ball, in such a way that the ball rolls from the structure at a speed and direction which can consistently be repeated. It has been discovered that a preferred shape of such a structure includes a clothoid shape as at least part thereof.

From a physics point of view, the job is to transfer potential energy into kinetic energy and to make a ball, such as a golf ball, roll as soon as possible on the launcher without sliding. The clothoid is a part of the Euler's Spiral function and a rolling ball structure having a clothoid curved shape was designed to make the launch of the ball.

The concepts described herein illustrate a ball rolling device (also sometimes referred to herein as a ball launch), having a first portion with a clothoid shape and having an angle through which a ball obtains enough speed such that the ball rolls on a surface for a distance which is greater than distances obtained with similarly sized devices. In one particular embodiment, a ball rolling device for use with a golf ball, has a first portion with a clothoid shape and an angle through which a golf ball obtains enough speed such that the golf ball rolls on a surface of a golf green for a distance which is greater than distances obtained with similarly sized devices (i.e. even though the ball rolling device described herein is smaller than prior art devices, a golf ball rolls on a golf green for more distance than is achieved with prior art devices).

According to calculations, it was decided to make a link between the clothoid's entry and exit using a 30° angle and connecting both clothoids by a circumference arc, and with designing tools (e.g. computer aided design or CAD) that allow to do it. A handmade drawing would be almost impossible to make due to the precision that is required. Mathematical calculations were made to optimize the design of the clothoid. Optimization parameters regarding the shape of the curve include, but are not limited to: length of the clothoids and arc, radius of the arc, transition points between the curves, scaling, entry and exit angles, and clothoid section to be used. It should be appreciated that the general shape of the ball launcher is a clothoid-arc-clothoid shape, but nevertheless, there are some degrees of freedom within this general shape and concept.

It should, of course, be appreciated that that these optimizations were made for golf balls, but the concepts described herein apply equally well to other types of rolling objects (e.g. other types of balls) and any variation on the optimization parameters with respect to the use of the clothoid for any type of rolling object is considered to be within the scope of the invention.

The dimensions of the angles of the ball launcher may be adapted to different golf balls and distances one wants to achieve. The description provided herein provides generalization of the use of the clothoid as a ball launch. The moment of inertia of the ball is the feature that allows to personalize the clothoid ball launcher. It should be appreciated that in some of the embodiments described herein, the standard characteristics of golf balls were used to optimize the device for use with a golf ball on a green. It should however, be appreciated that variations are also possible and within the scope of the concepts disclosed herein. For example, a device offering more accuracy vs. speed or vice-versa is possible. In fact, one could optimize the clothoid for all different balls and manufacturers. The device may be optimized by adjusting any optimization parameter which does not violate the basis of the device, which is to provide a ball launcher which includes a clothoid shape. Thus, the clothoid ball launcher is a device to putt with precision (as opposed to a stimp-meter which, as mentioned above, is merely a ramp used to measure green speed).

The ball launcher is provided having a clothoid shape selected to improve or in some cases even optimize the transfer the potential energy of the golf ball into kinetic energy. The ball launcher could be manufactured in different sizes. For example: (1) a first size for putts inside 5 yards; (2) a second size for putts from 5 to 12 yards; (3) a third size for putts inside 18 yards; or (4) a fourth size or any other distance not specified herein.

The ball rolling device described herein can thus be used: (1) as a device to help a golf player (i.e. or more simply "a golfer") to read greens and chose strategies; (2) for fun, to putt with the ball rolling device having a clothoid shape; (3) in golf tournaments in which all players would have access to a clothoid ball rolling device and thus have access to the same conditions and the same information with regard to putting characteristics; and (4) in tournaments with a rolling ball devoice having a clothoid shape to evaluate a player's SAF (speed, aiming and feeling).

In one embodiment, the ball rolling device can be provided having a laser or other alignment element coupled thereto. In the case of a laser, the laser would be aligned with respect to the ball rolling device such that a laser beam (having a wavelength visible to the human eye) is emitted in a direction which is aligned along a direction of a ball launched from the ball rolling device. The incorporation of a laser or other alignment element or device would make it easier to align or aim the ball rolling device at a desire point (e.g. a golf cup or other location). The laser could project a line that would allow the clothoid ball rolling device to be aimed exactly at the desired point.

Furthermore, the ball rolling device having a clothoid shape can be provided having numbers or other marks or indicia disposed thereon to help a user determine a distance traveled by a ball launched from the ball rolling device. The ball rolling device can also be provided having a mark thereon indicating the speed of the stimp-meter. Thus, the ball rolling device could also replace the stimp meter. Since, a ball device having a clothoid shape has a size which is smaller than a stimp meter, the ball rolling device would be handier for the green-keepers to transport in place of a stimp meter.

Use of the ball rolling device allows one to (e.g. with the use of a calculator): (1) calibrate a speed of a golf green; and (2) determine a point on the ball rolling device from which to release a golf ball (e.g. depending upon the distance that the ball has to go, one would have different numbers where one could let the ball go from—i.e. each of the different numbers corresponding to different release points on the ball rolling device).

With the above in mind, a calculator, personal digital assistant (e.g. an iPad®), cellular phone (e.g. such as an iPhone® or Blackberry® device) or other processing device (all collectively referred to herein as a processor) and a display can be provided as part of the ball rolling device. Such a processor and display may be physically coupled to the ball rolling device or may be coupled via a wireless link (e.g. using a so-called "Bluetooth" protocol or other wireless protocol for exchanging data over short distances) or via a wired link. In one embodiment, the surface of the ball rolling device which contacts a surface of the ball to be rolled is provided having one or more sensors coupled thereto such that the location of the ball on the surface of the ball rolling device can be accurately known and that ball location on the launcher as well as other information can wirelessly transmitted to an electronic device (e.g. a processor or processing device).

With a processor and the ball rolling device, one could determine the substantially precise line to be used to convert a putt with different strategies. Thus, the ball rolling device allows a golfer to know how he/she would have to make a putt with a selected speed before the golfer actually makes the putt. The technique would just be a relation between marks on the device and the distance traveled in a particular green. It would need to be calibrated with some trials first.

Owing to the connectivity described above, the concept will also include the capability of sending data to a software application. Thus, it is intended that the concept of providing data from the ball launcher to a software application to perform a task be within the scope of this patent.

All of the above are possible because the ball rolling device having a clothoid shape provides, with a unique precision, the speed, direction and consistency of the rolling ball as if it were putted. This is a feature which allows one to calculate ideal trajectories (e.g. via a processor).

In general, in accordance with a further aspect of the concepts and devices disclosed herein, artificial intelligence (as may be programmed or otherwise provided in the above-described processor or processing device, for example) may be used to learn actual ball trajectories (e.g. golf ball trajectories over greens) and to estimate the best virtual trajectories.

One could prepare a processor with specific formulas to make the next function. After making a putt with only one break, one will be able to know the parameters needed to know how the ball traveled in introducing certain data (such as that described in the following paragraph) in the processor Data which may be useful to provide to a processor includes, but is not limited to: the speed as the scale number and the alignment in relation to the distance from the edge of the hole (e.g. in a direction identified by a laser signal); and the distance in a straight line to the hole. With this data, the processor will be able to provide to a golfer other trajectories which could be used to make the putt as well as a distance by which the ball will go by the hole in case the ball does not go in the hole.

Additionally, one could use a parabolic function (e.g. as computed in a processor) to resolve single break putts and one could work to eventually do the same for putts with double breaks.

In accordance with a still further aspect of the concepts, structures and techniques described herein, a ball rolling device includes a pair of ball support structures secured together and spaced apart so as to support a golf ball there between. Each of the ball support structures has a first portion having a first end and a second end having a first surface with a clothoid shape and a second portion having a first end coupled to a second end of said first portion and a second end, said second portion having a first surface having an arc shape and a third portion having a first end coupled to the second end of said second portion and having a second end, said third portion having a first surface having an inverted clothoid shape.

With this particular arrangement, a ball rolling device (or ball launcher) which can help a golfer read greens and choose putting strategies is provided.

In one embodiment, the coupling between the three portions of the ball rolling device of is tangent and conserves a desired curvature.

In one embodiment, the ball rolling device has a non-constant curvature of the first surface of the first portion defined by $\rho_1=\pi\eta_1$ In one embodiment, a constant curvature of the first surface of the second portion is defined by $\rho_2=1/R$. The constant curvature of the second portion has to be substantially equal to the curvature at the second end of the first portion $\rho_2=\rho_{1B}$.

In one embodiment, a non-constant curvature of the first surface of the third portion is defined by $\rho_3=\pi\eta_3$. The curvature at the first end of third portion is preferably substantially equal to the curvature of second portion, i.e. $\rho_{3A}=\rho_2$. A third portion is provided as an inverted clothoid and the length of an arc $\eta_3$ is measured along a surface of the curve from the second end to the first one.

In one embodiment, a curvature of the first surface of the first portion is defined by $\rho_1=\pi\eta_1$; a curvature of the first surface of the second portion is defined by $\rho_2=1/R$; and a curvature of the first surface of the third portion is defined by $\rho_3=\pi\eta_3$.

In one embodiment, the ball rolling device includes the attachment of any appendage or extra portion with any shape at the first end of the first portion and/or at the second end of the third portion.

It should also be appreciated that any sort of scaling or variation (e.g. scaled by a function that changes the shape up to a degree where it is still useful for the task it is intended to perform) of any of the ball launcher portions may be done. This also includes the removal of any of its portions, i.e. scaled by zero.

The investigations described herein support the fact that the clothoid-arc-clothoid shape provides a ball rolling device having a substantially optimum trajectory that a falling ball can follow in order to convert its potential energy into kinetic energy. Although different shapes (and thus trajectories) can be used, such shapes/trajectories will not be as appropriate for the special task of rolling a golf ball as the clothoid-arc-clothoid shape.

An optimum range of starting angles is obtained depending upon the friction coefficient of the surfaces and the moment of inertia of the ball to be rolled. It should be appreciated that different types of balls (e.g. golf balls, billiard balls, rubber balls, bowling balls, etc. . . . ) all have different friction coefficients of the surfaces and moments of inertia, but the principles of the concepts described herein apply to any type of ball. Thus, to illustrate the concepts described herein an exemplary ball rolling device described below was optimized for golf balls, as this sector makes an excellent example of the purposes of the device. Also, a physical explanation of why the rail-to-rail distance is larger at the beginning and decreases towards the end is given.

BRIEF DESCRIPTION OF THE DRAWINGS

The foregoing features of the concepts, structures and techniques described herein may be more fully understood from the following description of the drawings in which.

DETAILED DESCRIPTION OF THE PREFERRED EMBODIMENTS

Figure 1:
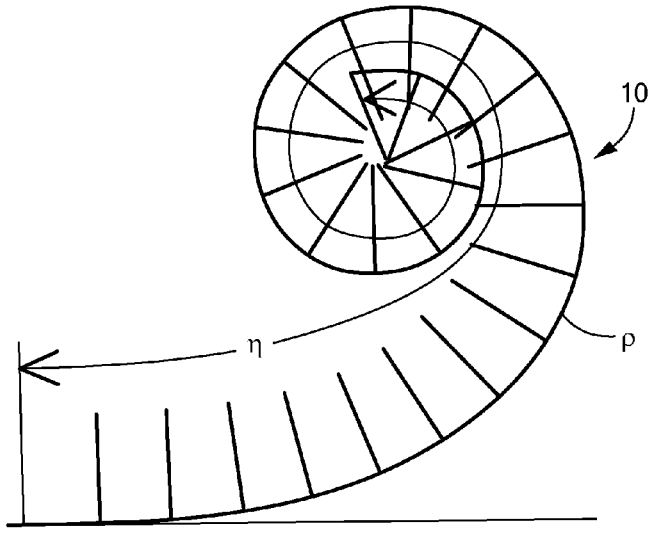
FIGS. 1 and 2 is are diagrams of a shape of a curve used to make a portion of a ball roller.

Referring now to FIG. 1 a general clothoid shape 10 is shown. In order to provide a smooth motion of a ball, leading to optimum kinetic energy, the best trajectories between a starting point and a landing surface (e.g. a golf green or a floor) were found to be those involving certain curves. The main characteristic of these curves is that the curvature along a path, $\rho$, is a function of the length of arc, $\eta$. A specific family of these curves is known as clothoids. Clothoids are also called spirals of Cornu or spirals of Euler. The curvature of a normalized clothoid is given by:

$$P=d\phi/d\eta=\pi\eta$$

And a radius of curvature, R is easily derived as follows:

$$R=\rho^{-1}=1/\pi\eta$$

This means that a straight line (R=infinity) can be smoothly converted into an arc and vice versa by the use of a clothoid.

Figure 2:
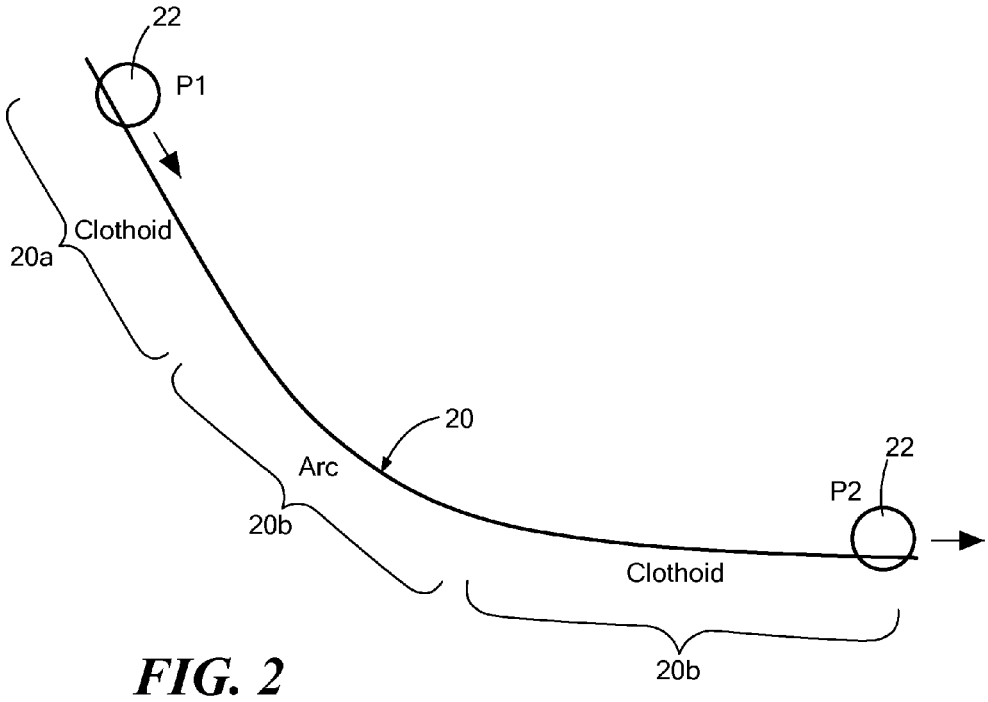

In view of the above and referring now to FIG. 2, a rolling hall device 20 has a first portion 20*a* having a clothoid shape, a second portion 20*b* having an arc shape and a third portion 20*c* having a clothoid shape. As will be explained herein, it can be shown that the best path for a ball 22 to move from position P1 to position P2 as shown in FIG. 2 is given by a shape corresponding to a clothoid-arc-clothoid shape. FIG. 2 shows a ball rolling device having a clothoid-arc-clothoid shape.

The concepts described herein illustrate a ball rolling device (also referred to as a ball launch), having a first portion 20*a* having a first steep angle through which ball 22 obtains enough speed to roll a distance greater than that which can be achieved by a like sized ball rolling device having a different shape (i.e. a shape other than a clothoid-arc-clothoid shape) with a sized device.

Figure 4:
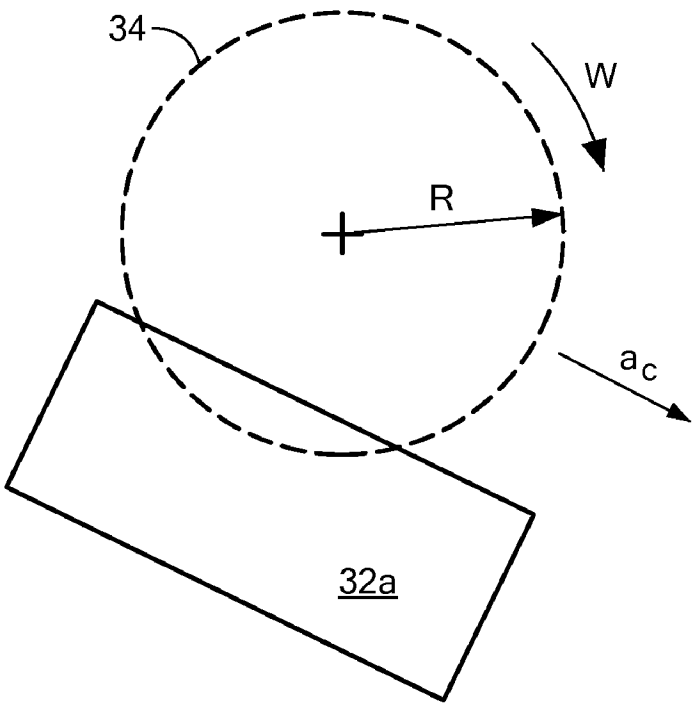
FIG. 4 is a side view of a ball rolling device.
Figure 3:
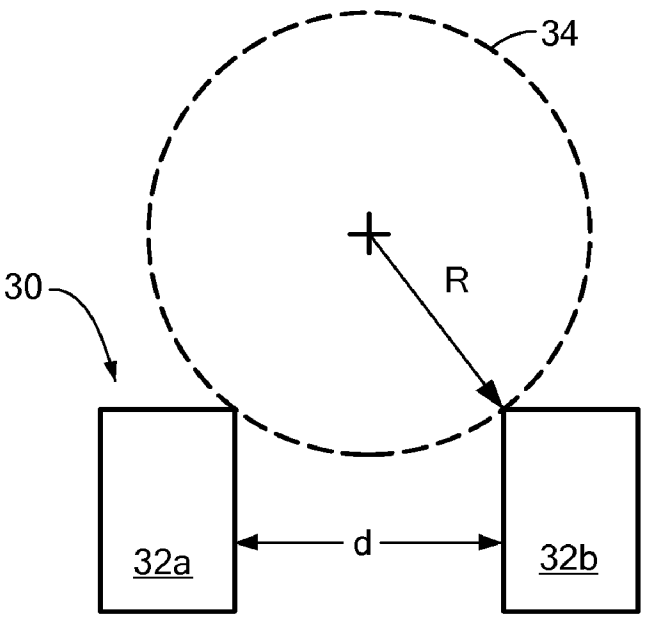
FIG. 3 is an end view of a ball rolling device.

Referring now to FIGS. 3 and 4, a ball rolling device includes two rails separated by a distance d (two rail system). A ball 34 is shown positioned on the rails 32*a*, 32*b* such that a surface of ball 34 contacts surfaces of rails 32*a*, 32*b*. Ball 34 is here shown in phantom since it is not properly a part of ball rolling device 30.

One important characteristic of the ball rolling device described herein is that there is no need for a large distance behind to let the ball accelerate. This comes from the fact that the starting angle of the first clothoid (e.g. portion 20*a* in FIG. 1) is selected to be as close to vertical as possible. The tangent acceleration of the ball is maximized at the beginning and smoothly decreased in order to provide an optimum or rear-optimum motion.

Imagine two different situations, a rolling ball and a sliding ball. It can be shown that due to the effect of moment of inertia, a rolling ball will cover the longest distance. Therefore, the device requires a non-slip surface on the path along which the ball travels. The closest angle to the vertical corresponds to the beginning of the first clothoid, and this is why the starting angle is an important factor in the design of a ball rolling device.

According to the equations of motion of a certain ball with radius, R, and moment of inertia, $k_c mR^2$, rolling through rails separated by a distance, d; the limit angle (measured from the vertical and also sometimes referred to hereinbelow as a "starting angle") for the non-slip condition can be derived as:

$$\phi=90°-\tan^{-1}((1/\mu_s)((k_c+1)/k_c))(1-(((1d^2)/(k_c+14R^2)))/\mathrm{sqrt}(1-d^2/4R^2))$$

In which:

$k_c$ is the inertial constant which varies with the object;

m is the mass of the ball;

$\phi$ (phi) is the angle of the first end of the first section to the vertical;

$\mu_s$ is the static friction coefficient; and the ratio $d^2/R^2$ falls within the range of $0.5<d^2/R^2<1.5$ for the ball to remain stable all along the device.

It can be seen from the equation above that in order to obtain the most vertical slope of the clothoid, the static friction coefficient $\mu_s$ should be the largest. As the material of the ball is always fixed, the best way to increase the static friction coefficient between surfaces (i.e. a surface of the ball and a surface of the ball rolling device) is to take advantage of the friction capabilities of rubber. Nonetheless, friction on rubber is not a straightforward issue and it will strongly depend upon factors including but not limited to: temperature, humidity and compound of each rubber, as well as cleanness of the surfaces in contact. Thus, it is be appropriate to deal with a range of angles depending upon different values of the static friction coefficient $\mu_s$. Other uncertain aspects as hollows on the surface of the ball (e.g. a golf ball) or rubber degradation will only sustain this thesis.

As from engineering handbooks, static friction coefficient $\mu_s$ for normal compounds of rubber vs. a variety of materials will approximately fall within the range $0.5<\mu_s<1.2$; where 0.5 corresponds to very hard compounds and 1.2 to soft compounds under dry conditions. Other elastomers can provide larger values of static friction coefficient $\mu_s$.

As an example, for a moment of inertia of $I=\frac{2}{5}\,mR^2$ and $d^2/R^2=1.37$ (corresponding to the first portion of the ball rolling device having a clothoid shape), the range of angles will be the following:

| Friction Coefficient, $\mu_s$ | Starting Angle |
|---|---|
| 0.5 | 31.5° |
| 1.2 | 14° |

These angles may vary slightly depending upon the moment of inertia of the ball, although the dominant term is the static friction coefficient $\mu_s$. It is important to note that in most of sport balls the distribution of density within the ball leads to moments of inertia larger than $I=(\frac{2}{5})\,(mR^2)$.

In order to investigate this effect, an addition of a 10% on the moment of inertia can be considered. Thus:

| Friction Coefficient, $\mu_s$ | Starting Angle |
|---|---|
| 0.5 | 33° |
| 1.2 | 15° |

According to these results, the working range of starting angles (also referred to hereinabove as a "limit angle") for a ball rolling device for use with solid balls will be given by $14°<\phi<33°$, although the minimum angles can only be reached under optimum conditions.

Being consistent with the derivation, one could also consider inflatable balls, whose moment of inertia will be close to $I=(\frac{2}{3})\,(mR^2)$. In this case, the optimum angle will rely within the range $19°<\phi<40.5°$, always depending upon factors including but not limited to the compound of rubber and environmental conditions.

From the equations of motion of the ball described in conjunction with FIGS. 3 and 4, the acceleration (ac) of its center of mass can be derived and given by the expression below:

$$a_c=((1-(d^2/4R^2))/(1+k_c-(d^2/4R^2)))g\sin(90°-\phi)$$

It is not obvious how the ratio of d/R will affect the final value of the acceleration for a fixed angle and ball.

It should be appreciated that the shape of the elastomer or the shape of the rail surfaces on which the ball rolls may be selected for use with certain types of balls (e.g. a golf ball vs. another type of ball or rolling object). In some applications, it may be preferred to provide rails having a sharp edge (e.g. a substantially right angle edge) while in other applications a rounded edge may be preferred. Also, the thickness of the rubber or elastomer on the edge may be selected based upon the particular application. Also the rails be coated with a spray of some sort rather than applying a separate piece to the rails.

Figure 5:
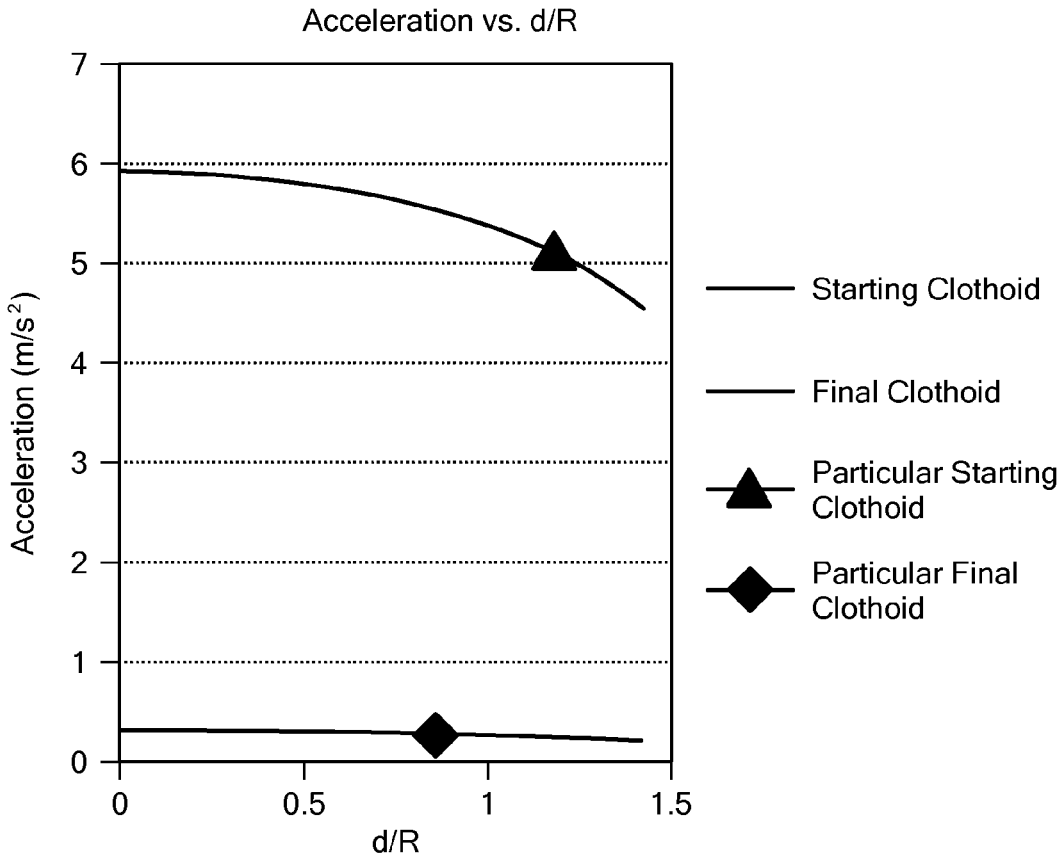
FIG. 5 is a plot of acceleration vs. the ratio d/R.

Referring now to FIG. 5, a plot of acceleration ($m/s^2$ vs. the ratio d/R how acceleration ac behaves in relation to d/R for an infinitesimal segment on both the starting and final clothoids (note that the starting angle $\phi$ was chosen as an average of each clothoid).

As one can appreciate, the smaller the distance between rails the larger the acceleration; however, the larger the distance between rails the better the stability of the ball. Consequently, it is possible to discuss some conclusions regarding to the design of the device.

First of all, it is important to consider the different manners in which a person (e.g. a golfer) places the ball on the starting position. The way the person releases the ball is not always the same, introducing variations on the motion along the first section of the device. Hence, in order to provide as much stability to the system as possible, the ratio d/R has to be large enough.

On the other hand, the situation on the final clothoid (e.g. portion 20*c* in FIG. 2) is the other way round. The uncertain variations due to the effect of the placement of the ball can be neglected by this stage and not so much stability is required. This is the reason why the distance between rails decreases smoothly from the beginning toward the end increasing the acceleration compared to a fixed distance between rails.

This implies that an optimized acceleration profile is delivered to the ball.

All the major aspects of the design are described herein. It should be appreciated that the reason why the results where given in terms of ranges and not particular values is that there are factors that might affect the solution. Some of these factors include but are not limited to: (1) moment of Inertia of the ball: only the manufacturer knows the moment of inertia of every single ball; and it will differ from one to the other. Nonetheless, it can be derived either experimentally or by numerical integration of the distribution of density within the volume. Identical balls must be used when studying a green; (2) size of the ball: even though most of manufacturers use a golf ball diameter of 42.67 mm and exemplary device described herein was designed according to this size, it also works fine with different balls. As note above, identical balls must be used when studying a green in order to avoid this factor; (3) friction coefficient of rubber: as noted above, friction behavior on rubber is a complex issue. Friction coefficient will vary depending upon the rubber compound and degradation as well as external factors such as humidity, cleanliness, and temperature. It is recommended to use new balls with the ball rolling device, as internal defects or scratches might lead to unnecessary variations on their "repetitive" trajectory.

Maintenance of the rubber sections will be similar to the rubber of table tennis rackets, which means that they have to be regularly cleaned with water and non-invasive detergents or special cleaners. It is also recommended to change the rubber sections at least once every three months (depending upon use and storage conditions) to avoid degradation. Note that every single variation on the design is optimized for a certain compound of rubber, so an identical one must replace it. Soft compounds will need to be replaced more often than hard compounds.

Figure 6:
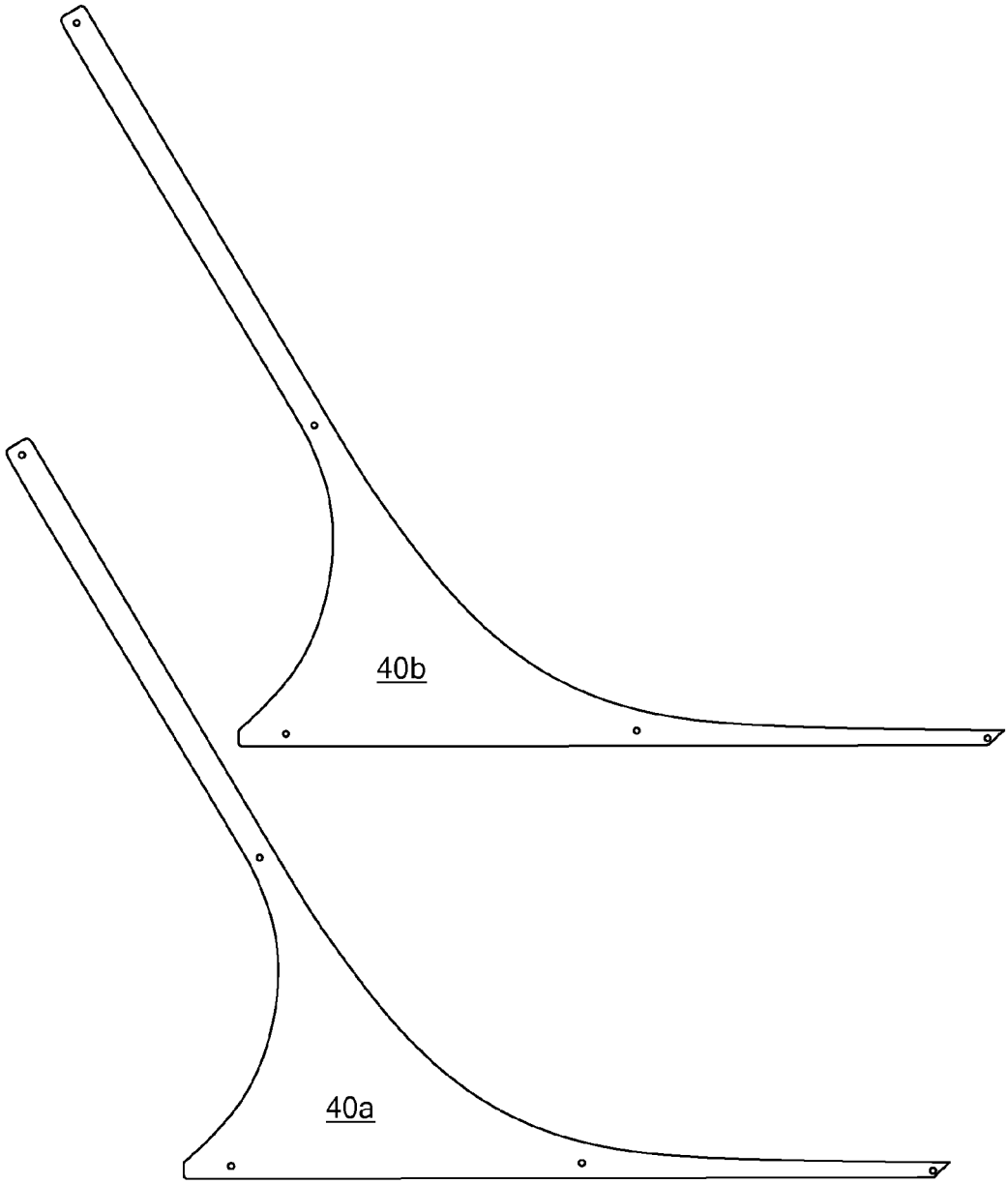
FIG. 6 is a diagram of an exemplary ball rolling device.

Referring now to FIG. 6, a process for fabricating a pair of ball support structures 40*a*, 40*b* for a ball rolling device is described. The steps are the following:

1. Draw the contour of pieces CLP01 and CLP02 using a CAD package. The lines and curves representing the desired contour are drawn in accordance with the concepts and techniques described above in conjunction with FIGS. 1-5.

2. Still in the CAD package (e.g. AutoCAD, I-Deas, Catia V6, Rhinoceros and Bentley Microstation), convert the contour into polylines so the CAD file can be imported by a CNC aluminum machine in order to cut pieces CLP01 and CLP02 and drill the holes. If the material from which the support structures 40*a*, 40*b* are provided is not aluminum, an equivalent process is required. It should be appreciated that any material can be used (e.g. metal or composite materials) but a light weight, strong material (e.g. aluminum, an aluminum alloy, titanium or titanium alloy, steel) is used. It should also be appreciated that the support structures must be a matched pair. That is, the size and shapes of support structures 40*a*, 40*b* should be matched to a mechanical tolerance achievable with conventional manufacturing equipment.

Figure 7A:
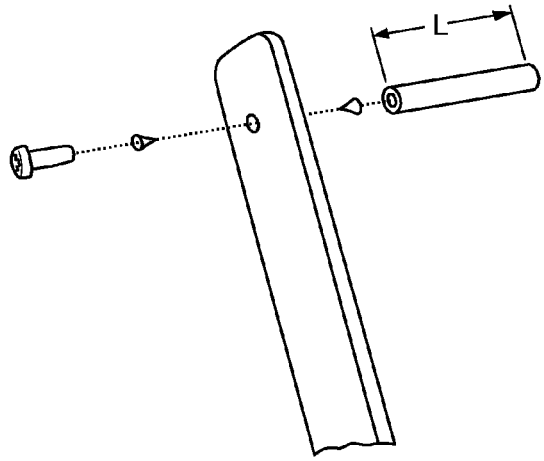
FIGS. 7-7E are a series of diagrams which illustrate a process to assemble a ball rolling device.
Figure 7:
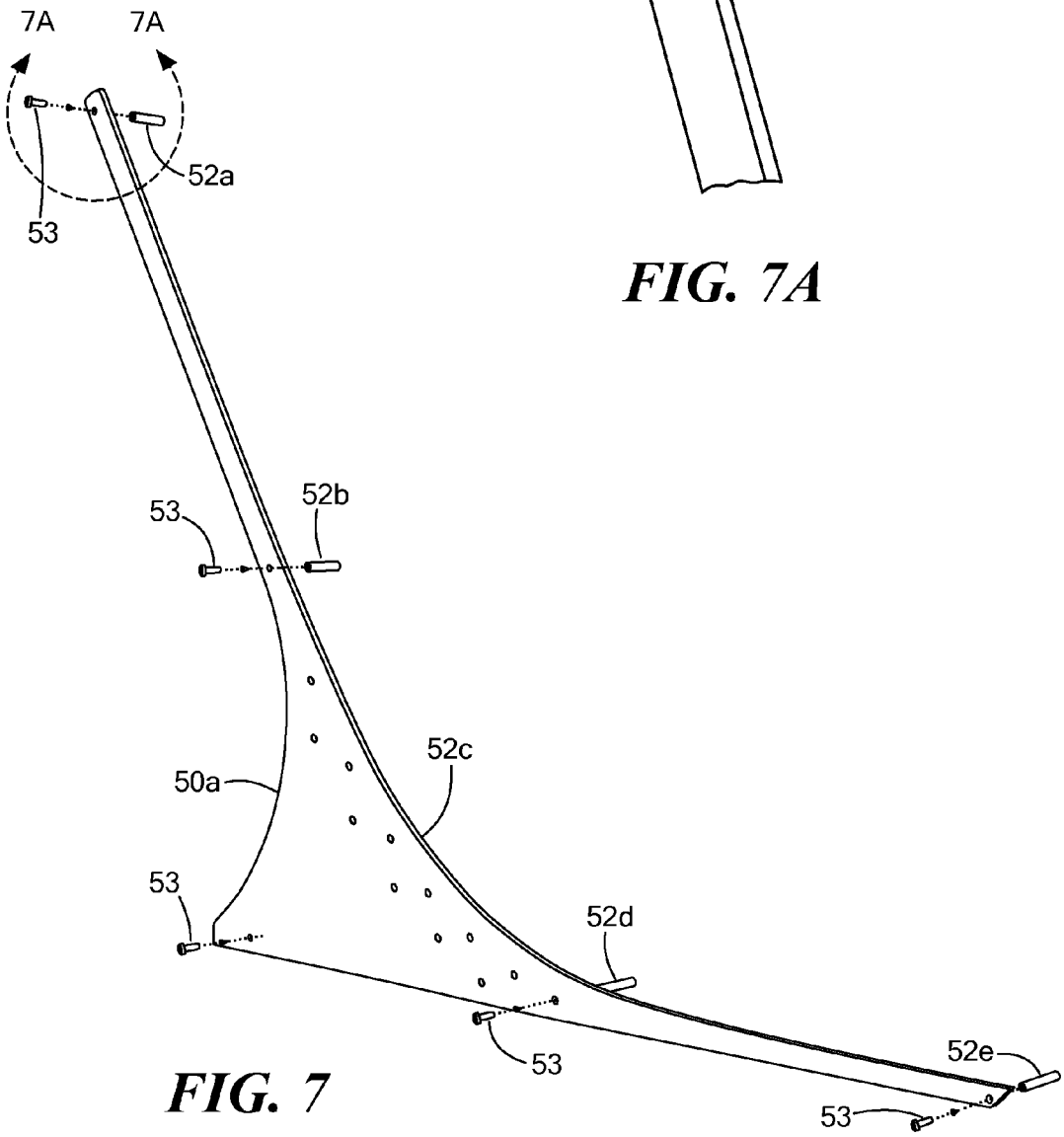
Figure 7C:
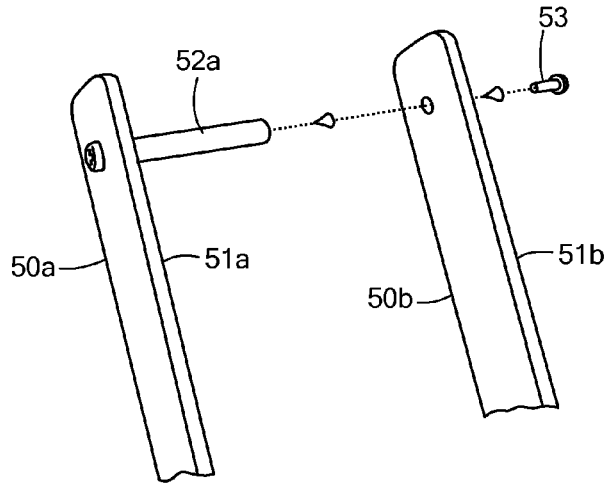
Figure 7B:
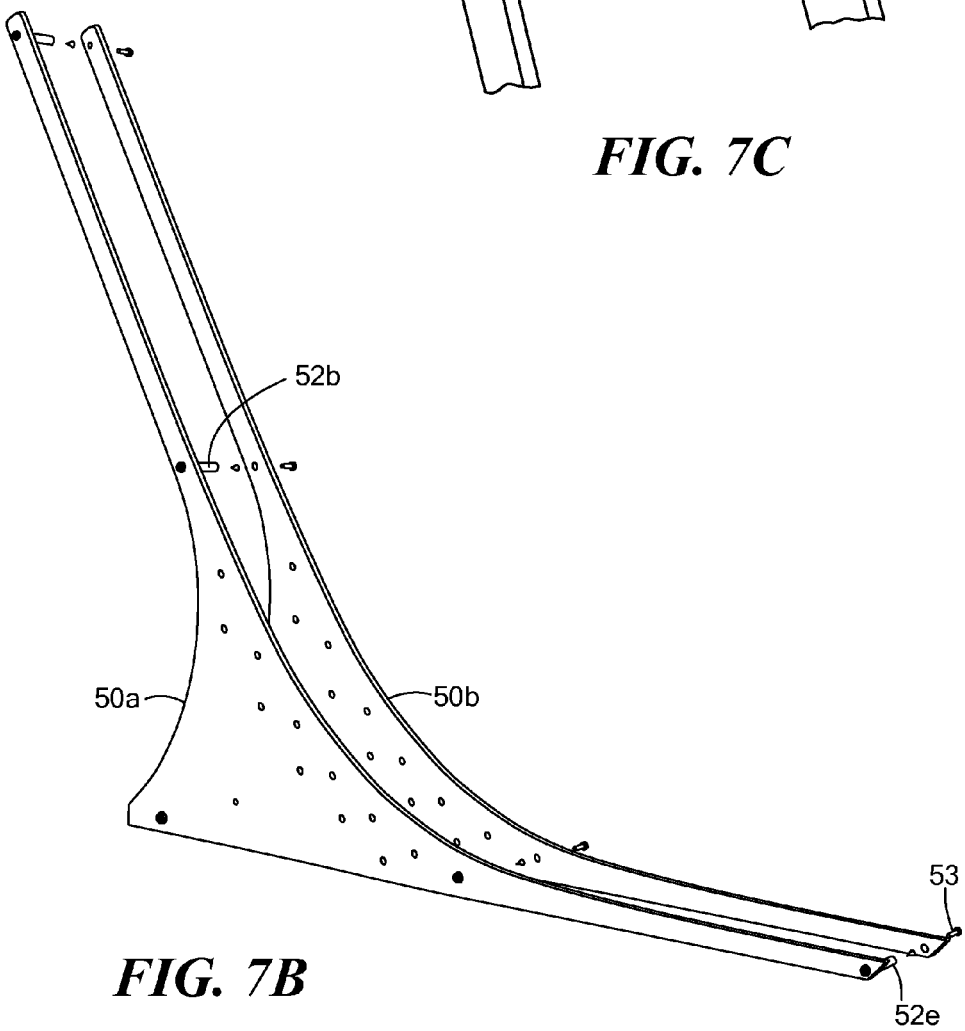
Figure 7E:
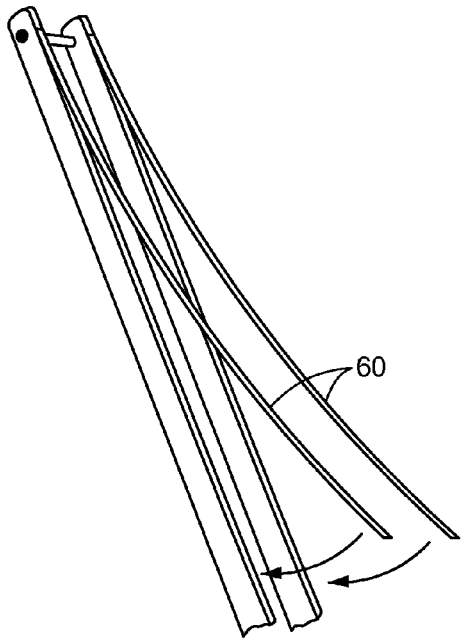
Figure 7D:
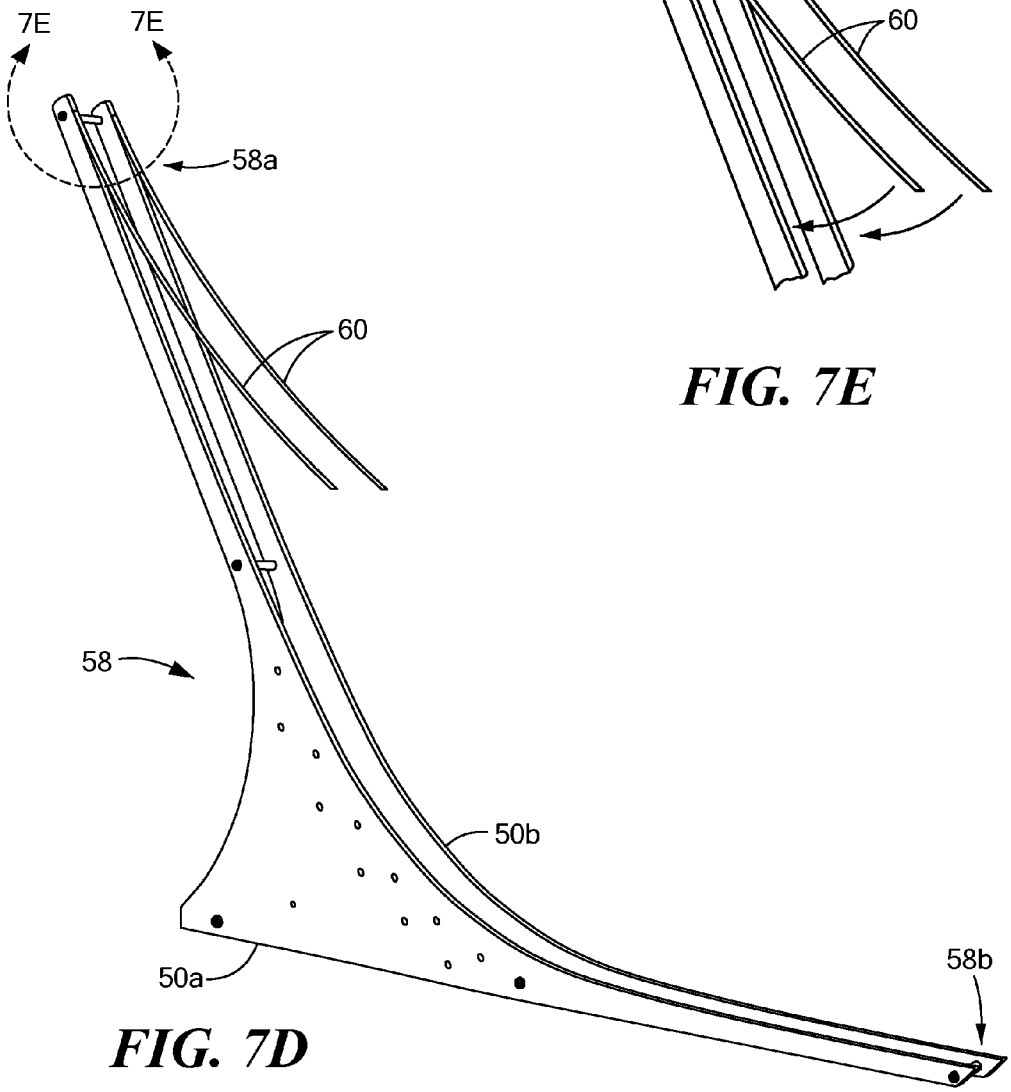

Referring now to FIGS. 7-7E in which like elements are provided having like reference designations throughout the several views, a support structure 50 has a series of standoffs 52*a*-52*e* coupled thereto view screws 53 (standoff 52*c* not visible in FIG. 7). Standoffs may also be coupled to support structure 50 via other fastening techniques well known to those of ordinary skill in the art. Each of standoffs 52*a*-52*c* are the same length L, however standoffs 52*d* has a length shorter than standoffs 52*a*-52*c* and standoff 52*e* has a length shorter than standoff 52*d*. A second support structure 50*b* is secured to support structure 50*a* via fasteners 53, to form a ball rolling device 58 (FIG. 7D) distance by which the surfaces of the support structures 50*a*, 50*b* are separated, changes from a first end 58*a* of ball rolling device 58 to a second end 58*b* of ball rolling device 58. In particular, the distance between rail portions 51*a*, 51*b* (FIG. 7C) of ball rolling device 58 decreases smoothly from the first end 58*a* to the second end 58*b*.

As shown in FIG. 7E, in one embodiment, rubber strips 60 are disposed over rail surfaces 51*a*, 51*b* to improve the traction between the rail surface and the surface of the ball placed on the rail.

Figure 8:
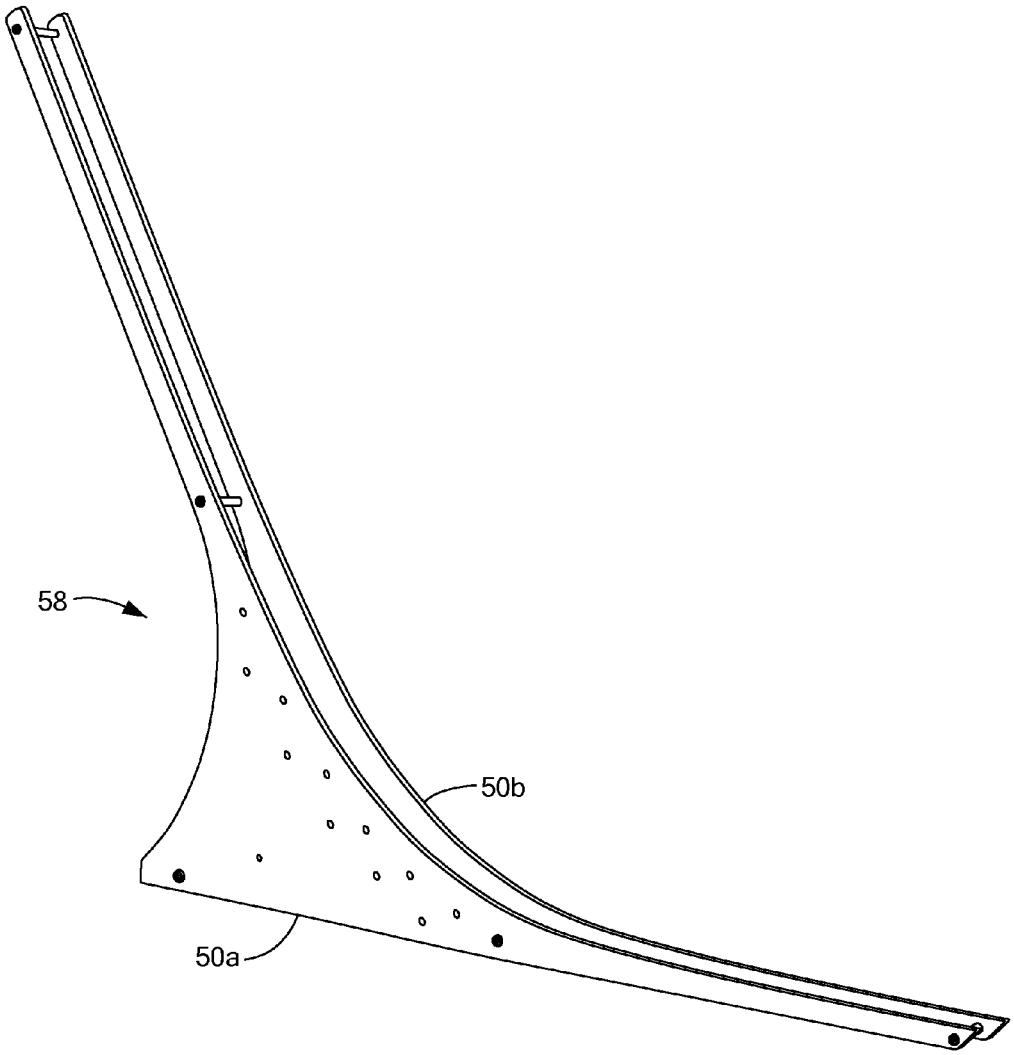
FIG. 8 is a perspective view of a ball rolling device.

Referring now to FIG. 8, an assembled ball rolling device is shown. The distance (i.e. height) of the rail at the end 58*b* will depend upon the height of the grass. Rubber would be provided in order to raise it and align it with the green. If the ball rolling device is used on solid surfaces (e.g. for use with a bowling ball in a bowling alley, for example), the optimum height would be zero. To determine a preferred total device height a calibration can be used. For example, in a golf ball launcher application, the overall height for a ball rolling device to simulate putts for inside yards; 5-12 yards; 12-18 yards (for example) a calibration would be necessary as it will depend upon the characteristics of the green. Other applications (e.g. bowling ball applications, for example), may have characteristics taken into account which may be different than the characteristics taken into account for a golf ball application.

Figure 9:
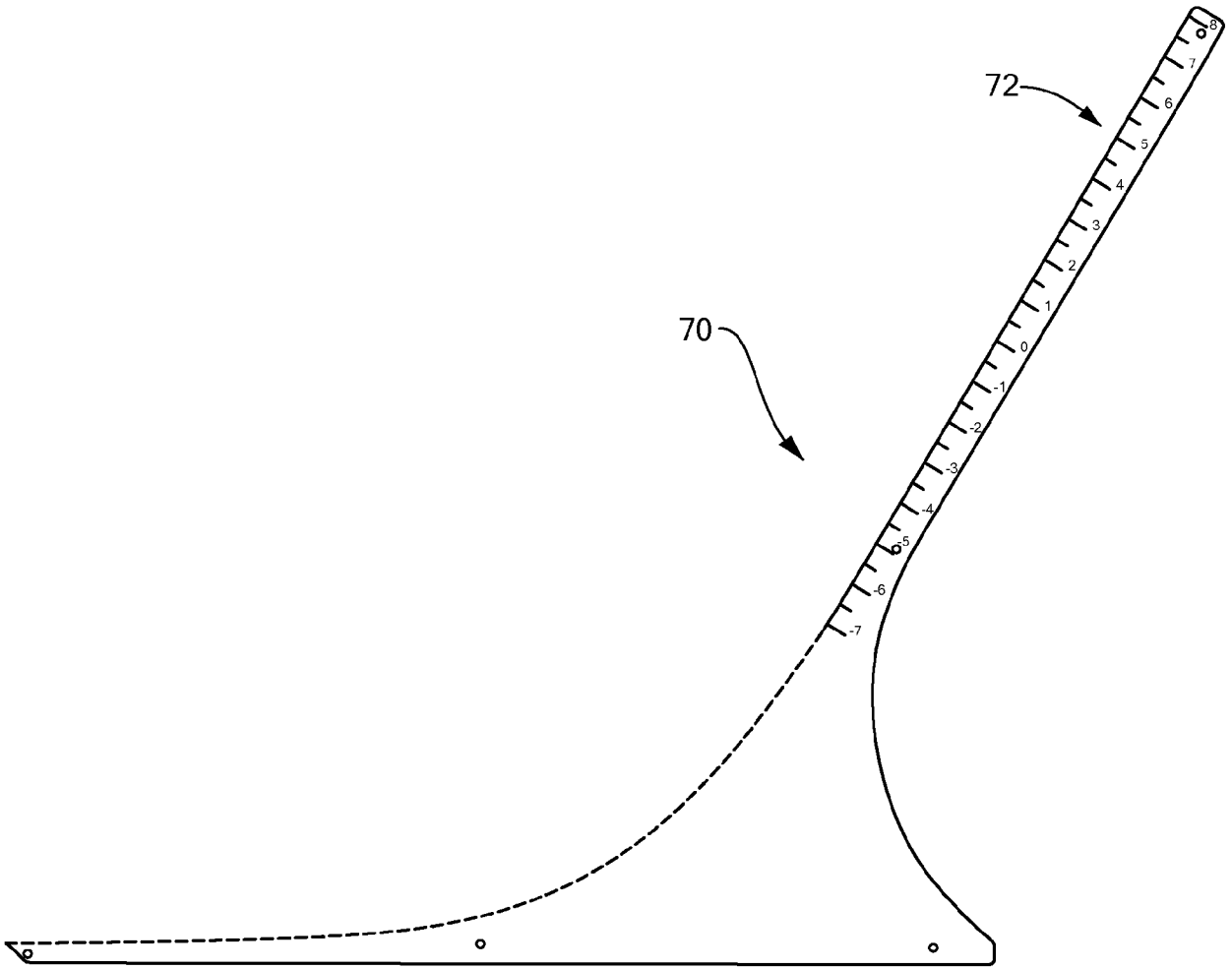
FIG. 9 is a side view of a ball rolling device.

Referring now to FIG. 9, a ball rolling device 70 includes a first portion having marks 72 (here shown as numbers) or indicia disposed thereon to help a user determine a position from which a ball was launched by the ball launcher. Thus, the marks aid a user in determining a particular location from which a ball is launched from the ball rolling device. A user can then determine a distance traveled by a ball launched from the particular location of the ball launcher.

The ball rolling device can also be provided having one or more marks thereon indicating the speed of a stimp-meter. Thus, the ball rolling device could also replace the stimp meter. Since, a ball device having a clothoid shape has a size which is smaller than a stimp meter, the ball rolling device would be handier for the green-keepers to transport in place of a stimp meter.

It should be appreciated that although the marks (or indicia) are here shown on a side surface of a portion of a ball launcher, the marks may also be located on other surface of the ball launcher (this may be in place of or in addition to the marks shown on the side portion).

Thus, use of the ball rolling device having numbers or indicia provided thereon allows one to (e.g. with the use of a calculator): (1) calibrate a speed of a golf green; and (2) determine a point on the ball rolling device from which to release a golf ball or other type of ball (e.g. depending upon the distance that the ball has to go, one would have different numbers where one could let the ball go from—i.e. each of the different numbers corresponding to different release points on the ball rolling device).

Figure 10:
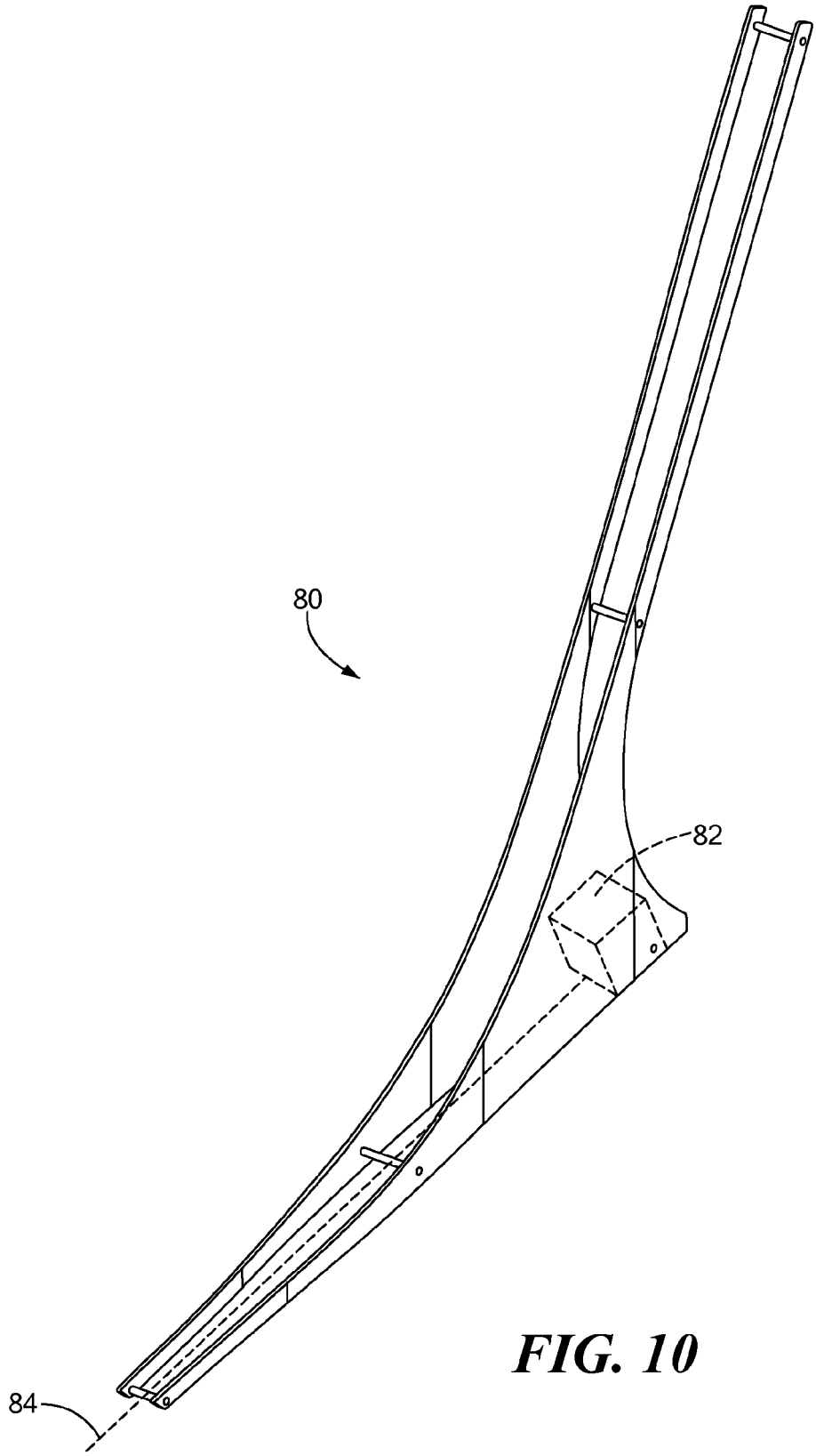
FIG. 10 is a perspective view of a ball rolling device having a laser.

Referring now to FIG. 10, a ball rolling device 80 includes an alignment device 82 coupled thereto. The alignment device may be provided as a laser or other alignment element coupled to the ball rolling device to assist in aiming the device in a particular direction or location. In the case of a laser, the laser would be aligned with respect to the ball rolling device such that a laser beam 84 (having a wavelength visible to the human eye) is emitted in a direction which is aligned along a direction of a ball launched from the ball rolling device. The incorporation of a laser or other alignment element or device facilitates alignment or aiming of the ball rolling device at a desired point (e.g. a golf cup or other location). The laser projects a line (e.g. a light beam) which allows the clothoid ball rolling device to be precisely aimed at a desired point.

Figure 11:
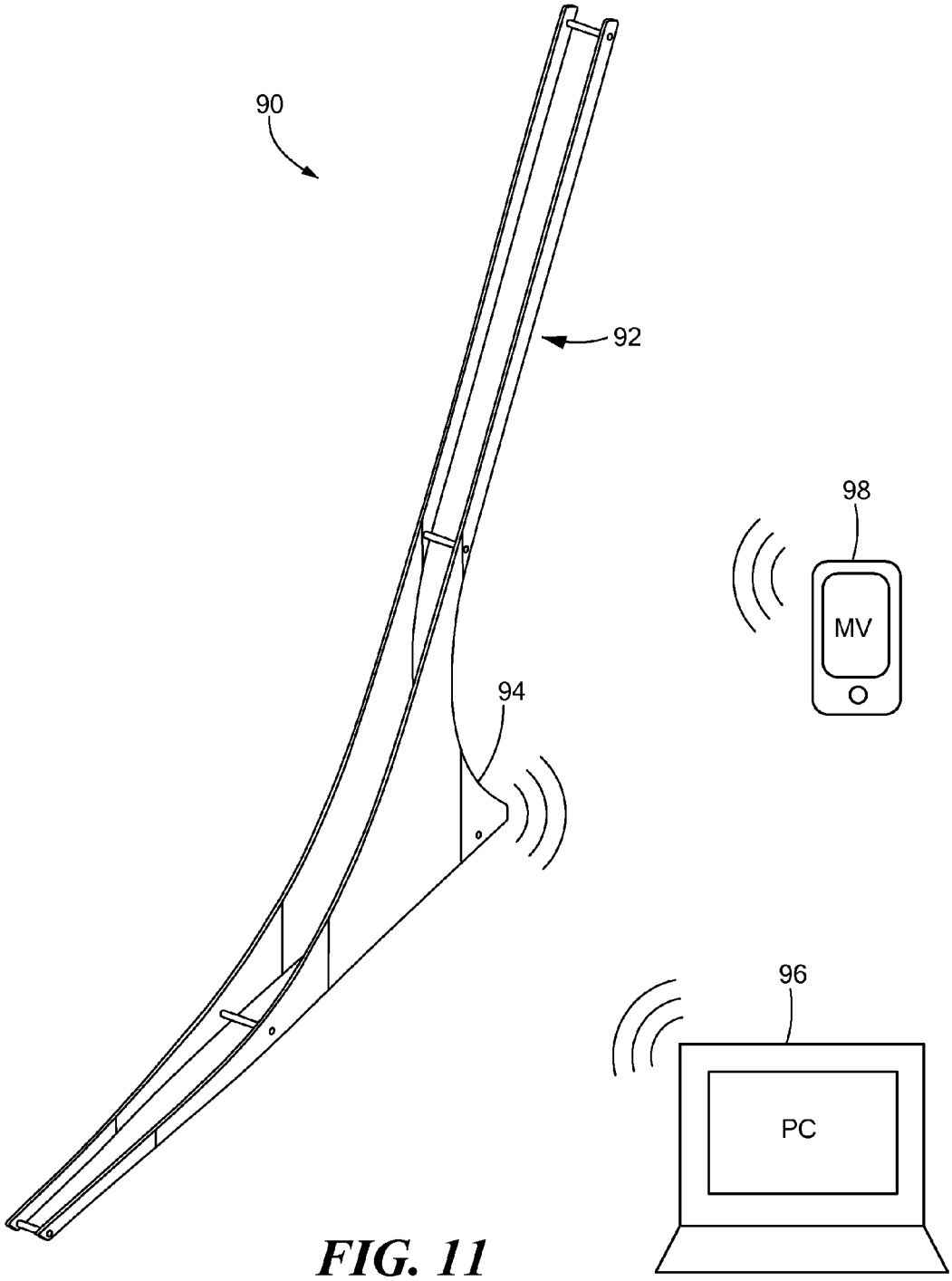
FIG. 11 is a block diagram of a ball launcher system having a processor and wireless connectivity.

Referring now to FIG. 11, a system 90 includes a ball rolling device 92 having a transmitter 94 coupled thereto. Transmitter 94 transmits data to one or more processors such as personal computer 96 (which may be provided, for example, as a laptop computer) or a handheld device 96 (e.g. an iPad®, iPhone® or Blackberry® device or other mobile platform). This allows one (e.g. with the use of a processor or calculator) to: (1) calibrate a speed of a golf green; and (2) determine a point on the ball rolling device from which to release a golf ball (e.g. depending upon the distance that the ball has to go, one would have different numbers where one could let the ball go from—i.e. each of the different numbers corresponding to different release points on the ball rolling device).

With the above in mind, a calculator, personal digital assistant (e.g. an iPad®), cellular phone (e.g. such as an iPhone® or Blackberry® device) or other processing device (all collectively referred to herein as a processor) and a display can be provided as part of a ball rolling system. Such a processor and display may be physically coupled to the ball rolling device or may be coupled via a wireless link (e.g. using a so-called "Bluetooth" protocol or other wireless protocol for exchanging data over short distances) or via a wired link. In one embodiment, the surface of the ball rolling device which contacts a surface of the ball to be rolled is provided having one or more sensors coupled thereto such that the location of the ball on the surface of the ball rolling device can be accurately known and that ball location on the launcher as well as other information can wirelessly transmitted to an electronic device (e.g. a processor or processing device).

With a processor and the ball rolling device, one could determine a substantially precise line to be used to convert a putt with different strategies. Thus, the ball rolling device allows a golfer to know how he/she would have to make a putt with a selected speed before the golfer actually makes the putt.

Owing to the connectivity described above, the concept includes the capability of sending data to a software application which performs some function. Thus, it is intended that the scope of this patent include the concept of providing data from the ball launcher to a software application to perform a task.

In general, in accordance with a further aspect of the concepts and devices disclosed herein, artificial intelligence (as may be programmed or otherwise provided in the above-described processor or processing device, for example) may be used to learn actual ball trajectories (e.g. golf ball trajectories over greens) and to estimate the best virtual trajectories.

One could prepare a processor with specific formulas to make the next function. After making a putt with only one break, one will be able to know the parameters needed to know how the ball traveled in introducing certain data (such as that described in the following paragraph) in the processor.

Data which may be useful to provide to a processor includes, but is not limited to: the speed as the scale number and the alignment in relation to the distance from the edge of the hole (e.g. in a direction identified by a laser signal); and the distance in a straight line to the hole. With this data, the processor will be able to provide to a golfer information on trajectories which could be used to make a putt as well as a distance by which the ball will go by the hole in case the ball does not go in the hole.

Additionally, one could use a parabolic function (e.g. as computed in a processor) to resolve single break putts, double break putts and/or putt having any number of breaks.

Figure 12:
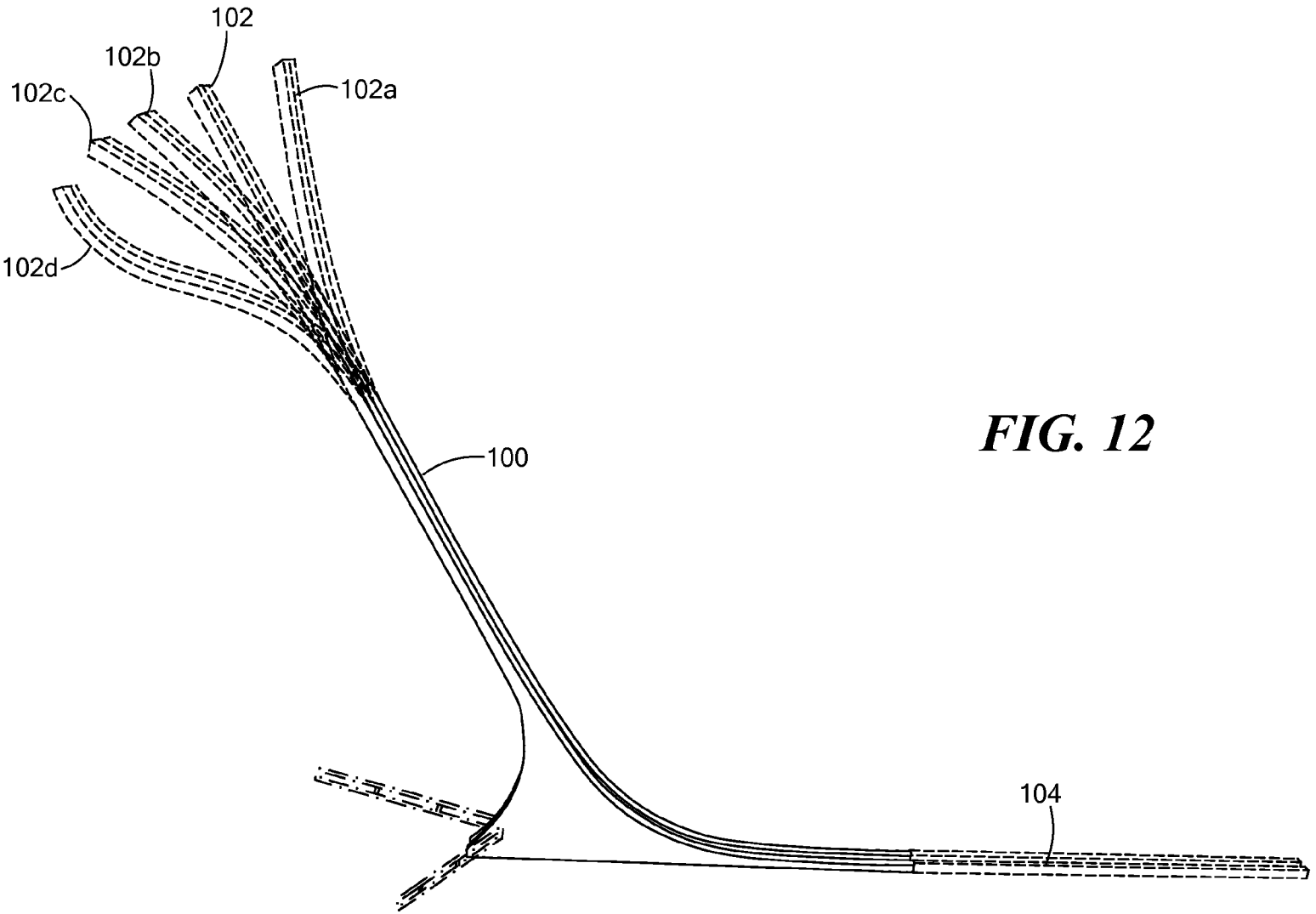
FIG. 12 is a perspective view of a ball rolling device having optional extensions coupled to the top and bottom thereof.

Referring now to FIG. 12, a ball launcher 100 includes one or more optional appendages or extension rails coupled to one or both of the first and second ends. As illustrated in FIG. 12, an appendage (or extension rail) 102 may optionally be coupled to a first end of a first portion of the ball launcher (i.e. the end where the ball enters the ball launcher). Extension 102 may be provided having a length and shape selected in accordance with the needs of a particular user and/or a particular application. Exemplary lengths and shapes are shown by extensions 102*a*-102*d*.

Similarly, an appendage (or extension rail) 104 may optionally be coupled to a second end of the third portion of the ball launcher (i.e. the end where the ball leaves the ball launcher). The length and shape of extension 104 may be selected in accordance with the needs of a particular user and/or a particular application.

In one embodiment, the ball rolling device includes the attachment of any appendage or extra portion with any shape at the first end of the first portion and/or at the second end of the third portion.

It should also be appreciated that any sort of scaling or variation (e.g. scaled by a function that changes the shape up to a degree where it is still useful for the task it is intended to perform) of any of the ball launcher portions may be done. This also includes the removal of any of its portions, i.e. scaled by zero.

The investigations described herein support the fact that the clothoid-arc-clothoid shape provides a ball rolling device having a substantially optimum trajectory that a falling ball can follow in order to convert its potential energy into kinetic energy. Although different shapes (and thus trajectories) can be used, such shapes/trajectories will not be as appropriate for the special task of rolling a golf ball as the clothoid-arc-clothoid shape.

An optimum range of starting angles is obtained depending upon the friction coefficient of the surfaces and the moment of inertia of the ball to be rolled. It should be appreciated that different types of balls (e.g. golf balls, billiard balls, rubber balls, bowling balls, etc. . . . ) all have different friction coefficients of the surfaces and moments of inertia, but the principles of the concepts described herein apply to any type of ball. Thus, to illustrate the concepts described herein an exemplary ball rolling device described below was optimized for golf balls, as this sector makes an excellent example of the purposes of the device. Also, a physical explanation of why the rail-to-rail distance is larger at the beginning and decreases towards the end is given.

Having described preferred embodiments which serve to illustrate various concepts, structures and techniques which are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. A ball rolling device comprising:

a pair of ball support structures secured together and spaced apart so as to support a golf ball there between, each of the ball support structures having:

a first portion having a first end and a second end having a first surface with a clothoid shape; and a second portion having a first end coupled to the second end of said first portion and a second end, said second portion having a first surface having an arc shape; and a third portion having a first end coupled to the second end of said second portion and having a second end, said third portion having a first surface having an inverted clothoid shape, wherein for $\eta$=the length of arc;

a curvature of the first surface of said first portion is defined by $\rho_1=\pi\eta_1$;

a curvature of the first surface of said second portion is defined by $\rho_2=1/R$; and a curvature of the first surface of said third portion is defined by $\rho_3=\pi\eta_3$.

2. The ball rolling device of claim 1 wherein portions of the ball rolling device at which the first and second portions are coupled and the second and third portions are coupled from a substantially tangent surface between each of the respective surfaces and conserves curvature.

3. The ball rolling device of claim 1 wherein the constant curvature of the second portion is substantially equal to the curvature at the second end of the first portion $\rho_2=\rho_{1B}$.

4. The ball rolling device of claim 1 wherein a curvature at the first end of said third portion is substantially equal to the curvature of said second portion such that $\rho_{3A}=\rho_2$.

5. The ball rolling device of claim 1 further comprising an appendage coupled to one of: the first end of the first portion; or the second end of the third portion.

6. The ball rolling device of claim 1 wherein each of the ball support structures is provided from a single piece of material having no joints between the first end of the first portion and the second end of the third portion.

7. The ball rolling device of claim 1 wherein each of the ball support structures is provided from a plurality of pieces of material joined to provide a monolithic structure.

8. The ball rolling device of claim 1 wherein each of the ball support structures are provided from aluminum.

* * * * *